US005538435A

United States Patent [19]

Yohn

[11] Patent Number: 5,538,435

[45] Date of Patent: Jul. 23, 1996

[54] ELECTRICAL INPUT/OUTPUT CONNECTOR WITH SWITCHABLE CONTACTS

[75] Inventor: Brent D. Yohn, Newport, Pa.

[73] Assignee: The Whitaker Corporation, Wilmington, Del.

[21] Appl. No.: 306,236

[22] Filed: Sep. 14, 1994

[51] Int. Cl.[6] ..... H01R 13/71

[52] U.S. Cl. ..... 439/188; 439/500

[58] Field of Search ..... 439/188, 500

[56] References Cited

U.S. PATENT DOCUMENTS

| | | | |
|---|---|---|---|
| 3,960,424 | 6/1976 | Weisenburger | 339/17 M |
| 4,070,557 | 1/1978 | Ostapovitch | 200/51.1 |
| 4,179,173 | 12/1979 | Rise, III | 339/19 |
| 4,224,486 | 9/1980 | Zimmerman, Jr. et al. | 200/51.1 |
| 4,330,164 | 5/1982 | Pittman et al. | 339/49 R |
| 4,439,000 | 3/1984 | Kaufman et al. | 339/176 MP |
| 4,477,134 | 10/1984 | Wright | 339/17 F |
| 4,552,423 | 11/1985 | Swengel, Jr. | 339/19 |
| 4,582,376 | 4/1986 | Olsson | 339/19 |
| 4,685,887 | 8/1987 | Hanning | 439/188 |
| 4,726,775 | 2/1988 | Owen | 439/49 |
| 4,737,118 | 4/1988 | Lockard | 439/289 |
| 4,786,258 | 11/1988 | Shaffer et al. | 439/188 |
| 4,941,849 | 7/1990 | Fujiura | 439/610 |
| 5,234,353 | 10/1993 | Scholz et al. | 439/289 |

FOREIGN PATENT DOCUMENTS

| | | |
|---|---|---|
| OS2903896 | 8/1979 | Germany . |
| 60-232674 | 11/1985 | Japan . |
| 2025711 | 1/1980 | United Kingdom . |

*Primary Examiner*—Neil Abrams
*Assistant Examiner*—T. C. Patel
*Attorney, Agent, or Firm*—Anton P. Ness

[57] ABSTRACT

An electrical connector assembly for a portable apparatus (42) such as a cellular telephone having a base unit. A first connector (10) on the portable apparatus (42) includes an array of contacts (18) along a mating face, engageable with an array of contacts (104) on a second connector (100) of the base unit. Certain contacts (50) of the first connector (10) are adapted to extend laterally therefrom to electrically engage electrodes (82,84) of an electrical component such as a battery (80) mounted within the portable apparatus (42), and have spring arm sections (54) exposed laterally of the mating face. The second connector (100) includes protuberances (130) extending forwardly of its mating face associated with the certain contacts (50) of the first connector and upon mating engage and deflect the spring arm sections (54) to disengage the certain contacts (50) from the battery electrodes (82,84). The certain contacts (50) re-engage the battery electrodes (82,84) upon unmating of the connectors to maintain a supply of power to apparatus components from the battery remote from the base unit.

9 Claims, 6 Drawing Sheets

ELECTRICAL INPUT/OUTPUT CONNECTOR WITH SWITCHABLE CONTACTS

FIELD OF THE INVENTION

The present invention is directed to electrical connectors and more particularly to axially matable input/output connectors.

BACKGROUND OF THE INVENTION

In U.S. Pat. No. 5,234,353 is disclosed a matable electrical connector assembly for an input/output port of an electronic apparatus such as a portable cellular telephone. Complementary plug and receptacle connectors include arrays of signal contacts across a mating interface and coaxial connectors at each end thereof. The signal contacts comprise mating pairs of like resilient cantilever beam contact arms that are disposed transverse of the mating interface and extend slightly forwardly of the front face of the housing to engage each other and deflect free ends of each other slightly rearwardly and mostly into the respective protective cavities. Body sections of the contacts extend axially rearwardly along respective passageways along which they are retained by interference fit by retention sections, extending to rearward contact sections disposed in a rear housing portion. Alternating ones of the front contact sections extend transversely in opposing directions to contact surfaces in staggered rows, matable with contact sections of the mating connector having similarly alternating front contact sections of the signal contacts. The rear contact sections of one of the connectors comprise tails adapted to be surface mounted to respective traces of a circuit board contained within the portable electronic apparatus, while the rear contact sections of the other connector may be terminated to respective wires of an electrical cable within a base unit. The plug and receptacle connectors are matable under low mating forces and have a long-term durability over at least 5000 mating cycles.

It is desired to provide a portable electronic apparatus with electrical connections between components on a circuit board therewithin to a battery power source when the portable apparatus is not cradled in its base unit, and with the electrical connections with the battery disengaged upon return of the portable apparatus to its base unit.

SUMMARY OF THE INVENTION

The present invention provides two or more contact members within a first connector mounted to a portable electronic apparatus at an input/output port thereof, with at least one including a spring arm first contact section that is adapted to be in spring-loaded engagement with the active electrode of an electrical component such as a battery, while another includes a spring arm first contact section adapted to be in spring-loaded engagement with the battery's ground electrode. The second contact sections are electrically connected to associated traces of the circuit board containing components needing to receive electrical power from a remote power source or battery when the portable apparatus is removed from its base unit. The second connector matable therewith includes at least one post member of the dielectric housing extending forwardly of the mating face thereof to be received during connector mating into a corresponding recess of the mating face of the first connector to engage a bearing section of the spring arm section of at least one of the contact members to deflect the spring arm section in a direction away from and out of engagement with an associated one of the battery's electrodes, all such as when the portable apparatus is returned to the base unit.

It is an objective to provide a connector assembly for an input/output port of a portable electronic apparatus that includes a switch actuable upon connector mating to disengage at least one contact of the apparatus-mounted connector from connection to a component such as a remote power source elsewhere within the apparatus to disrupt a circuit, while permitting reengagement thereof upon unmating during removal of the apparatus from its base unit.

It is a further objective to provide a base unit connector that is adapted to coact with contact members of the apparatus-mounted connector to disengage them from a remote power source.

Embodiments of the present invention will now be described by way of example with reference to the accompanying drawings.

BRIEF DESCRIPTION OF THE DRAWINGS

FIGS. 12 and 13 are longitudinal section views of the connectors of the present invention during mating and fully mated respectively, with a portion of the base unit connector broken away and a portion in cross-section.

DETAILED DESCRIPTION OF THE PREFERRED EMBODIMENT

Figure 9:
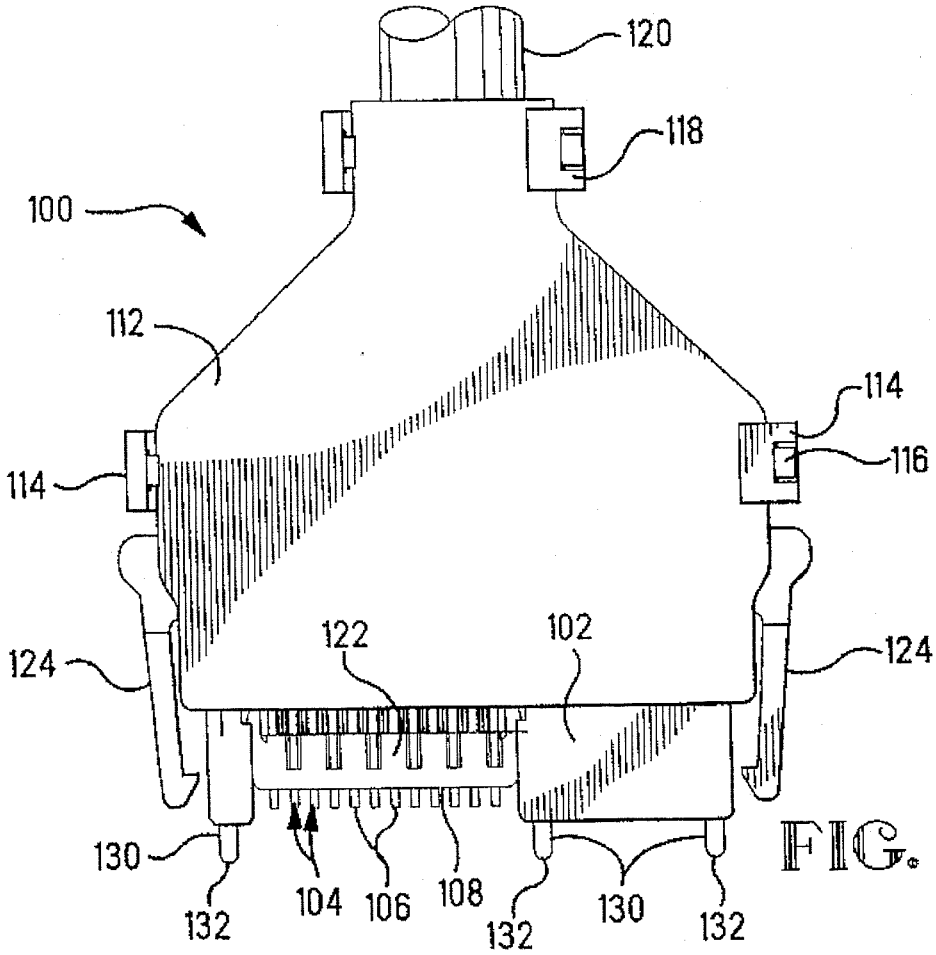
FIGS. 9 to 11 are elevation front, top and side views of the base unit connector respectively of the present invention matable with the connector of FIGS. 1 to 4.
Figure 10:
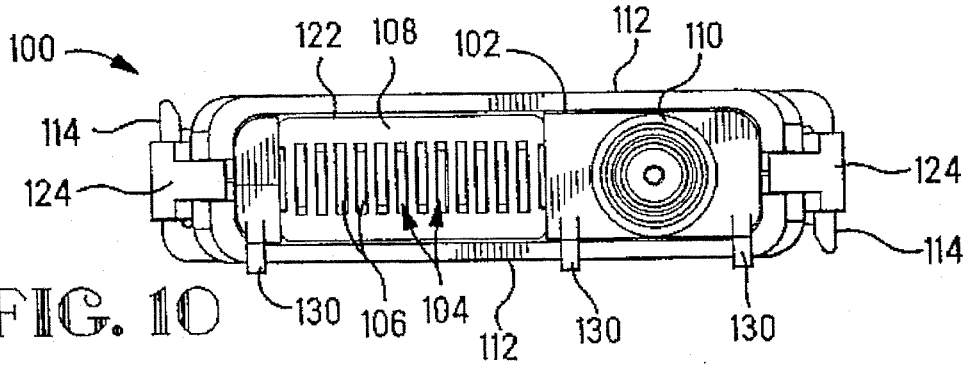
Figure 11:
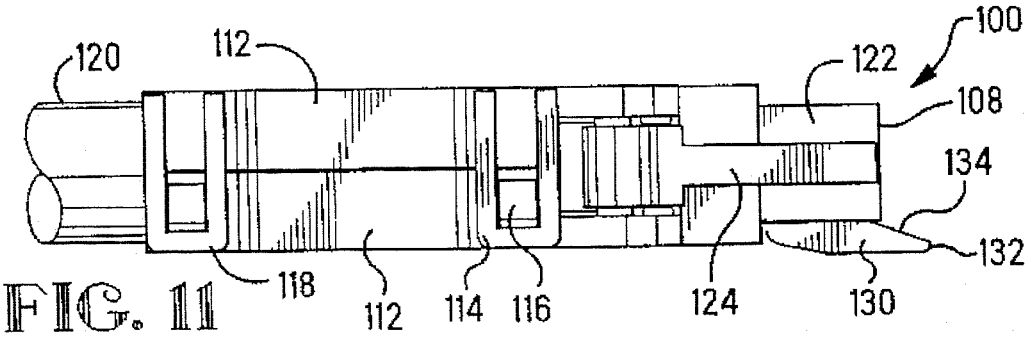

A first or apparatus-mounted connector 10 is illustrated in FIGS. 1 to 4, having a first housing 12 of dielectric material including a protective shroud section 14 surrounding front contact sections 16 of an array of first contact members 18 exposed along a first mating face 20 for signal transmission (and optionally power transmission), as well as a coaxial connector assembly 22, for electrical connection with second contact members of the second or base unit connector (see FIGS. 9 to 11).

Figure 4:
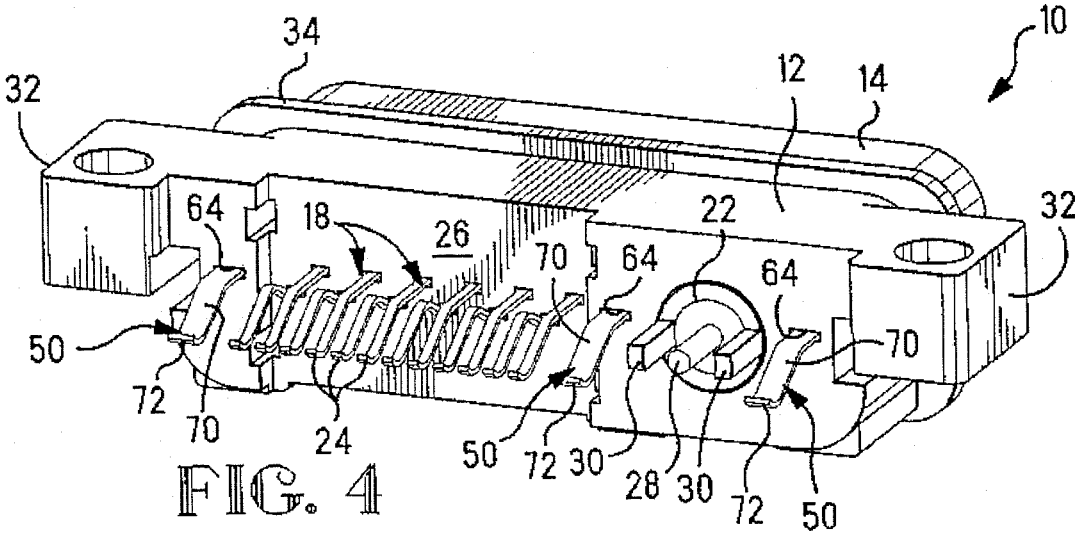
Figure 5:
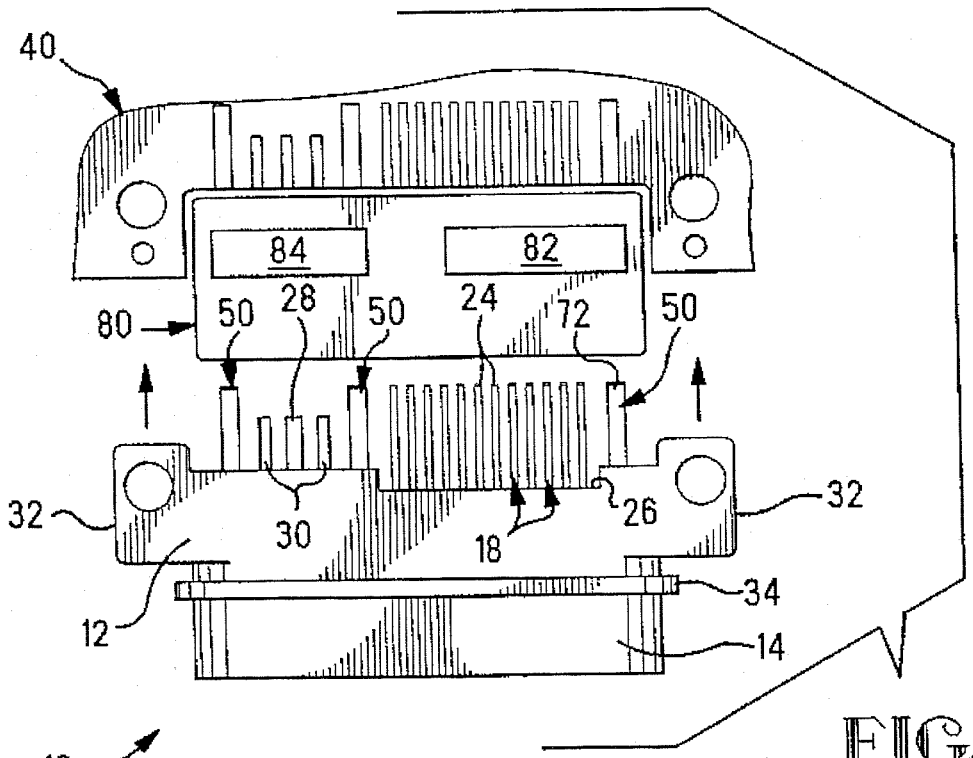
FIG. 5 is a plan view of the connector of FIGS. 1 to 4 in association with a circuit board to which it is mounted in the apparatus.

In FIGS. 4 and 5, rear contact sections 24 of first contact members 18 extend rearwardly from rear face 26 of connector 10 to become surface mounted to traces of a circuit board 40 of an apparatus such as a portable cellular telephone. Rear sections 28,30 of the inner and outer conductors of the coaxial connector assembly 22 are similarly surface mounted to corresponding traces of the circuit board. Mounting flanges 32 extending laterally from end of the housing to enable fasteners (not shown) to affix the connector to the circuit board, while peripheral flange 34 will be held within framework of the apparatus 42 at its input/output port 44 (FIGS. 7 and 8) to secure the connector thereat.

Figure 1:
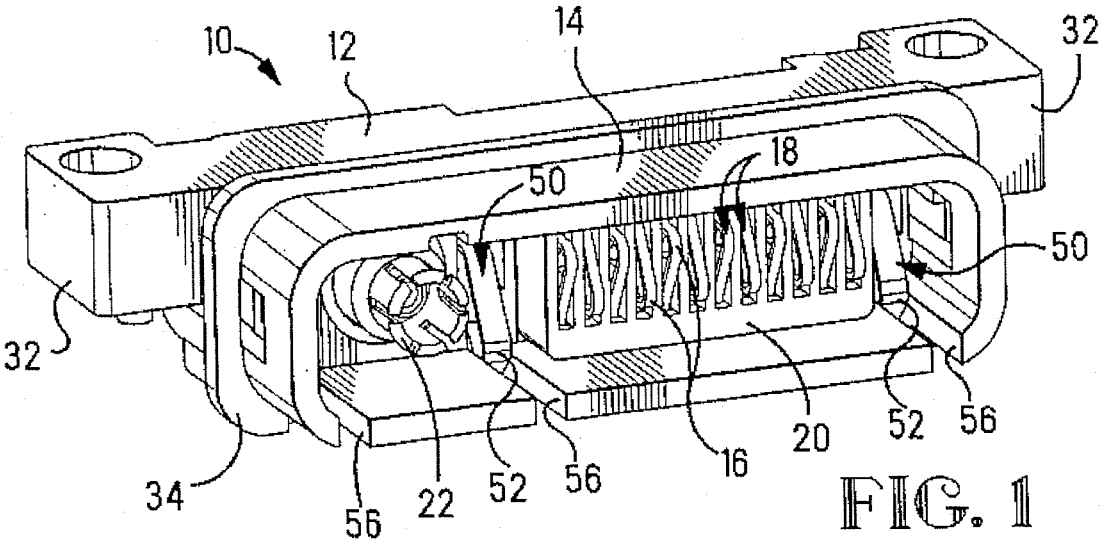
FIGS. 1 to 4 are isometric front, elevation front and side and isometric rear views, respectively of the apparatus-mounted connector of the present invention.
Figure 2:
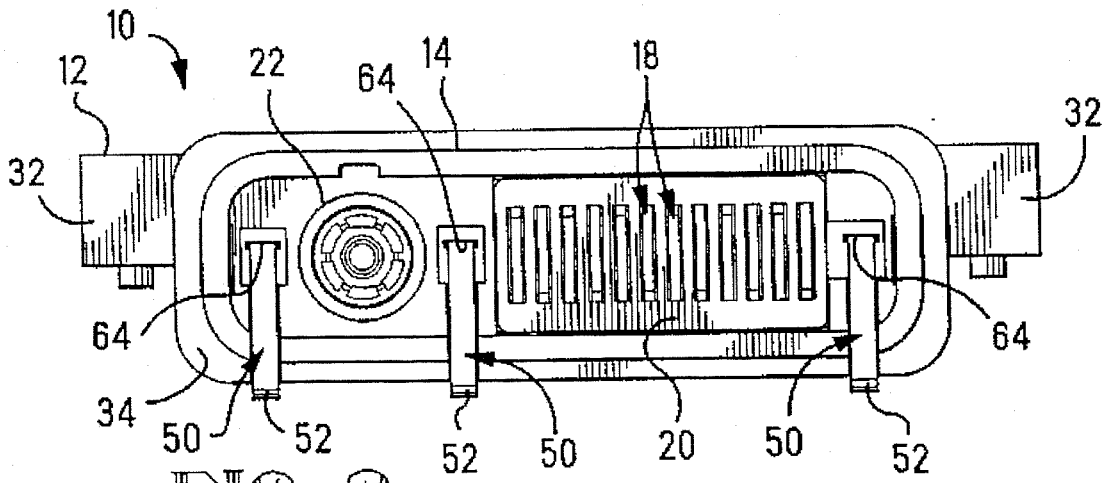
Figure 3:
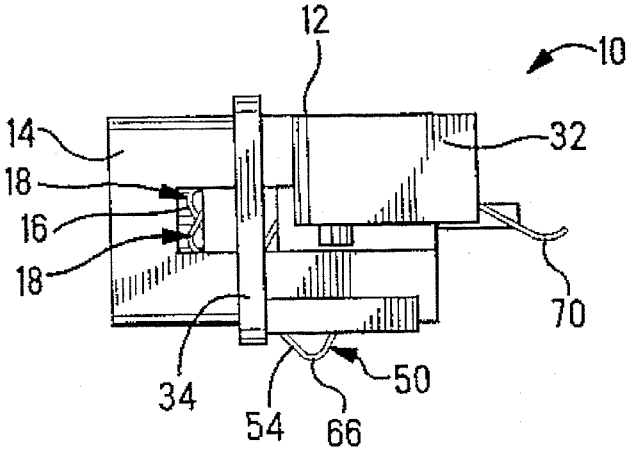
Figure 6:
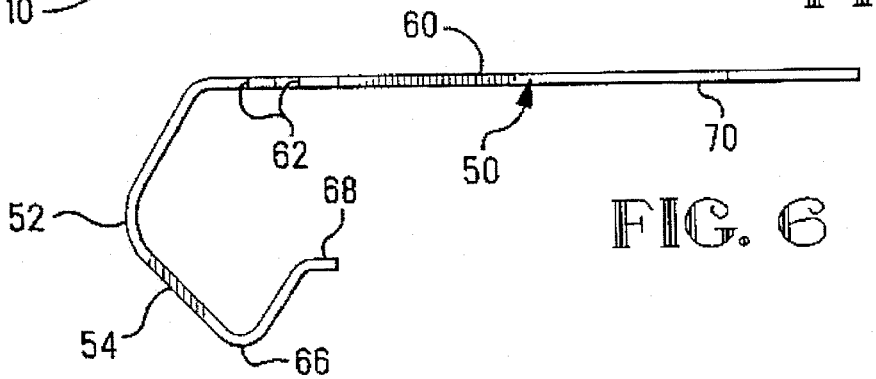
FIG. 6 is an elevation view of a battery-engageable contact member of the connector of FIGS. 1 to 5.

As shown in FIGS. 1 to 4, front sections 52 of three third contact members 50 are also exposed across the mating face of connector 10 and include spring arm sections 54 that protrude through recesses 56 of the housing shroud section 14 to depend below a mounting face 58 of connector 10 (FIG. 3). Such a third contact member 50 is illustrated in FIG. 6 and includes a body section 60 secured within housing 12 such as by barbs 62 digging into side walls of a respective passageway 64 of the housing upon insertion of third contact member 50 therethrough, in a manner such as disclosed in U.S. Pat. No. 5,234,353 with regard to signal contacts of the apparatus-mounted connector thereof, after which rear sections may be formed into an arcuate configuration as shown in FIG. 4. First contact sections 66 proximate free ends 68 of spring arm sections 54 will be spring loaded against battery electrodes of the apparatus, better seen in FIGS. 7 and 8. Rear sections 70 include second contact sections 72 engageable with associated circuits of the circuit board to transmit electrical power to components mounted on the circuit board (FIGS. 3, 4 and 7 and 8).

Figure 7:
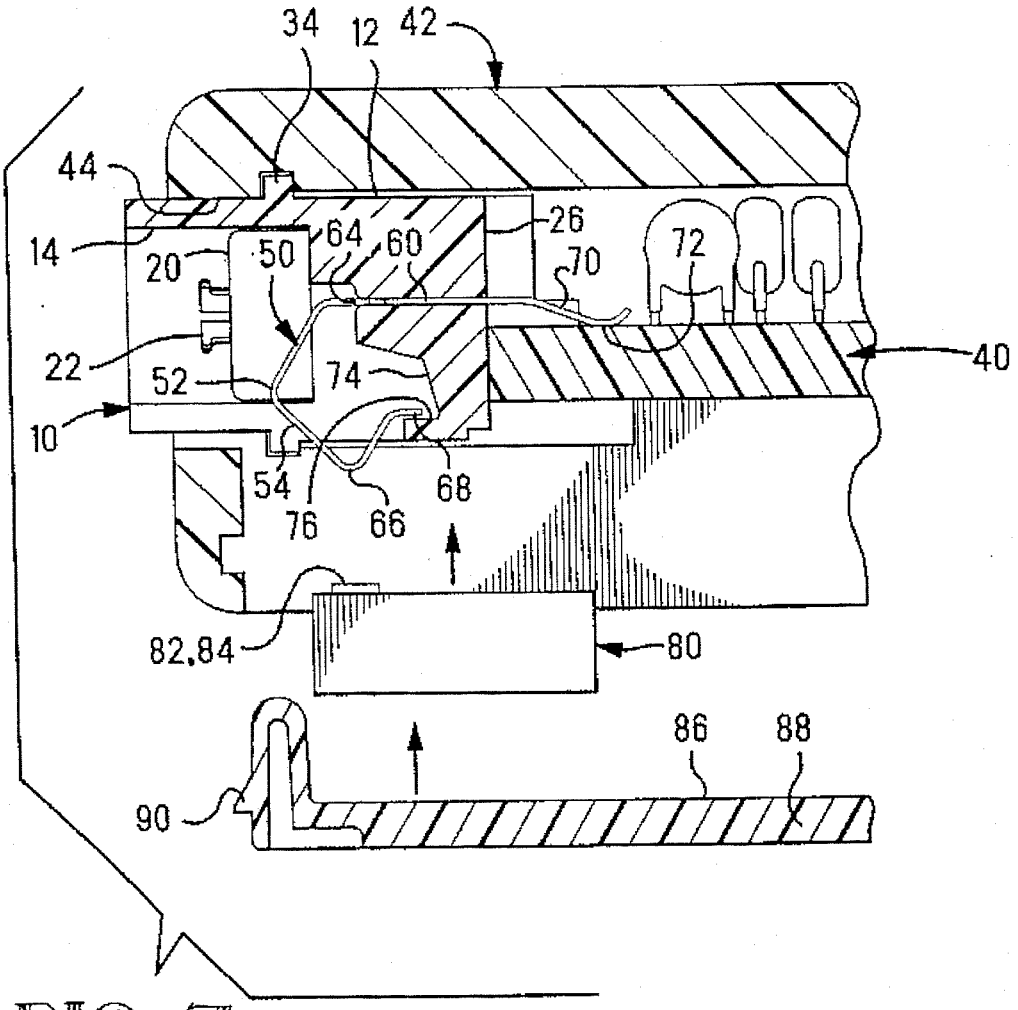
FIGS. 7 and 8 are longitudinal partial section views of the connector of FIGS. 1 to 4 being assembled to a circuit board within an electronic apparatus having a battery, and fully assembled with a contact of FIG. 6 engaged with a battery electrode, respectively.
Figure 8:
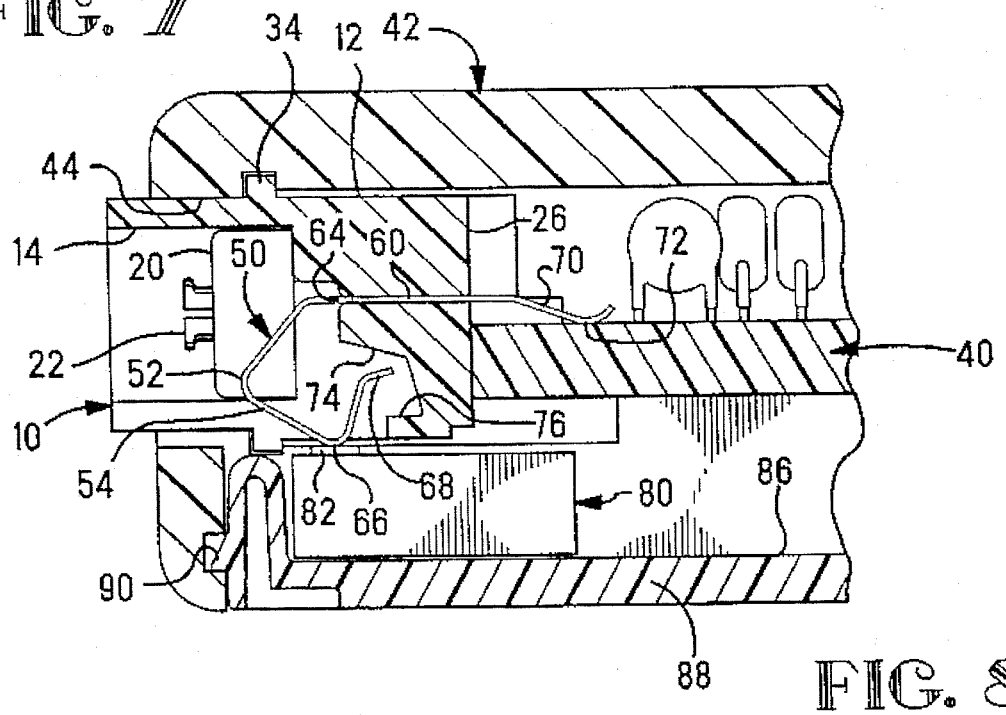

Referring now to FIGS. 7 and 8, connector 10 is shown being mounted to input/output port 44 of apparatus 42, which contains circuit board 40 and will also contain an electrical component such as battery 80 having active and ground electrodes 82 and 84 represented in FIG. 5. Upon assembly, first contact sections 66 of contact members 50 will become engaged with active and ground electrodes 82, 84 of battery 80 and be held in spring biased engagement therewith. Battery 80 is shown affixed to the inner surface 86 of a cover member 88 affixed to apparatus 42 such as by an array of latches 90 one of which is seen proximate input/output port 4, and optionally may be removably held in a nest of cover member 88 permitting removal and replacement, if desired. Second contact sections 72 thereof are electrically connected to active and ground traces of circuit board 40 and preferably soldered thereto, thus completing the electrical connection of the battery to the circuit board and thus to its components, upon full assembly of connector 10 to apparatus 42.

In FIGS. 7 and 8, housing 12 of connector 10 includes a relief region 74 rearwardly of front sections 52 of third or battery-engageable contact members 50. A lip 76 traps free end 68 of each contact member 50 permitting spring arm section 54 to protrude beneath connector housing 12 a desired distance for first contact section 66 to become engaged with a respective battery electrode. Relief region 74 permits clearance for free end 68 to travel within housing 12 upon deflection of spring arm section 54 when spring biased against a respective battery electrode upon assembly of apparatus 42, or upon deflection of spring arm section 54 out of engagement therewith upon connector mating (FIG. 13).

Second or base unit connector 100 is seen in FIGS. 9 to 11 and is to be mounted in a base unit (not shown) such that a second mating face 108 is exposed adjacent a cradle for portable apparatus 42 for mating with the first connector. Connector 100 includes a second housing 102 containing second contact members 104 having front contact sections 106 along second mating face 108 complementary with front contact sections 16 of first contact members 18 of first connector 10, and also includes a coaxial connector assembly 110 complementary to and matable with coaxial connector assembly 22 of first connector 10. A pair of cover members 112 (shown to be hermaphroditic) are adapted to latch to each other at latches 114 and projections 116 about connector housing 102. Cover members 112 preferably include cable strain relief 118 to clamp to the outer jacket of a cable 120 containing conductors to which contact members 104, 110 are terminated. Second mating face 108 is shown to be generally defined on a plug section 122 of connector 100 adapted to be received into shroud section 14 of first connector 10 surrounding first mating face 20. Connector 100 also is shown to optionally include mechanical coupling means such as a pair of latch arms 124 engageable with cooperating latch recesses of first connector 10 (FIGS. 1 and 3) to maintain the connectors in mated condition, assuring that the array of contact members are assuredly in electrical engagement with each other when the connectors are coupled, while permitting detaching for intentional unmating of connectors 10, 100 when portable apparatus 42 is being removed from the base unit.

Figure 12:
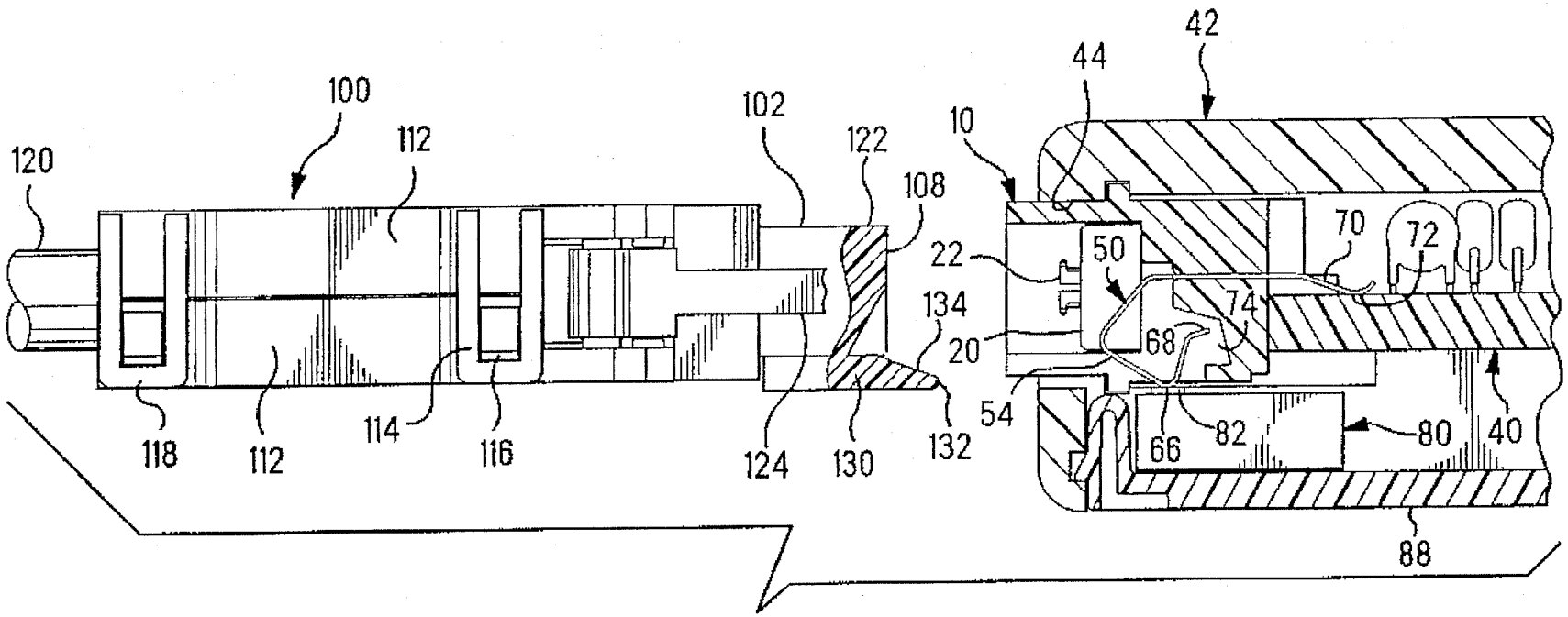
Figure 11B:
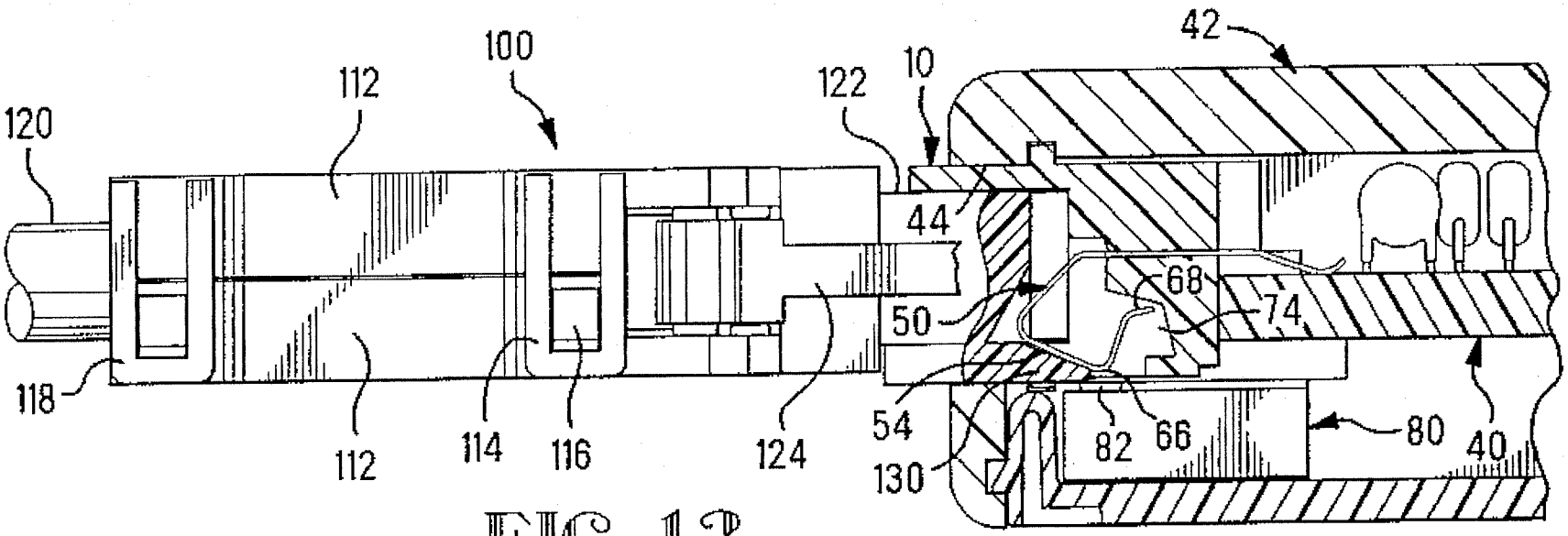

In accordance with the present invention, second connector 100 includes one or more protuberances 130 (there are three shown) extending forwardly of second mating face 108 extending to wedge-shaped leading ends 132. As seen best in FIGS. 12 and 13, protuberances 130 are adapted for angled bearing surfaces 134 thereof to engage front sections 52 of battery-engageable third contact members 50 of first connector 10 as the connectors are being mated and preferably prior to engagement of the other associated pairs of contact members, to deflect and hold spring arm sections 54 out of engagement with battery electrodes 82, 84. It may be desired to provide only one protuberance to disengage the particular battery-engageable contact member that is associated with the active electrode, thus effectively disrupting the circuit providing battery-supplied power to the circuit board components.

Other variations and modifications may be devised that are within the spirit of the invention and the scope of the claims. For example, it is foreseeable that only one protuberance is necessary to deflect only one of the battery-engageable contacts out of engagement with the battery thus disrupting the circuit. Further, it may be desired to provide a ground connection only, from the ground ones of the battery-engageable contacts to the base unit connector ground circuits using a contact section on the corresponding protuberances.

Protuberances of the base unit connector may also be devised to include defined thereon contact sections that become assuredly engaged with front sections of battery-engageable contacts of the handset connector upon connector mating, to transmit power to circuit board of the handset from the power system of the vehicle in which the base unit is mounted, such as an automobile, when the handset has been cradled in the base unit; traditionally, however, such power transmission has been provided to the portable apparatus through electrodes of the apparatus and base unit outside of the matable connectors themselves when the apparatus is nested in its cradle. Additionally such protuberances could also be modified to themselves engage the handset battery upon deflection of the battery-engageable contacts out of engagement, in order to transmit a trickle charge to the battery, if desired.

I claim:

1. A matable connector system suitable for electrically connecting a portable electronic apparatus to a base unit when the apparatus is cradled therewithin, comprising:

a first electrical connector mounted to an end of said portable apparatus and including an array of first electrical contacts retained within a first housing, each including a first contact section exposed across a first mating face of said first connector and extending to a second contact section electrically connected to circuits defined within said portable apparatus;

a second electrical connector complementary to and matable with said first electrical connector and mounted to said base unit, said second connector including a corresponding array of second electrical contacts retained within a second housing which first contact sections thereof exposed across a second mating face, each said second contact including a first contact section complementary to and electrically engageable with a said first contact section of an associated said first contact and further including a second contact section electrically connected to circuits defined within said base unit;

said first connector further including at least a pair of third contact members associated with an electrical component of said portable apparatus and including respective first contact sections disposed on spring arm sections associated with respective electrodes of said electrical component, each of said third contact members including a body section joined to said spring arm section thereof along said mating face and disposed in a respective passageway of said first housing, and extending therethrough from said first mating face to a second contact section rearwardly of said first housing and associated with a respective circuit defined within said portable apparatus;

said spring arm sections of said third contact members each depending from said first housing of said first connector for said first contact sections to become engaged with respestive said electrodes of said electrical component upon said first connector being assembled within said portable apparatus, and a said spring arm section of at least a selected one of said third contact members including a bearing surface exposed across said first mating face and adapted to be deflected toward said first housing; and said second connector including at least one protuberance extending therefrom associated with a respective said selected third contact member of said first connector, each said at least one protuberance including a camming surface adapted to engage said bearing surface of said spring arm section of said selected third contact member and deflect said first contact section thereof out of engagement with said component electrode, all upon mating of said first and second connectors, wherein when said first and second connectors mate upon placing of said portable apparatus appropriately in said base unit, at least one third contact member is disengaged from said component electrode disrupting the circuit previously defined, and said third contact member is re-engageable therewith upon unmating of said connectors when said portable apparatus is removed from said base unit.

2. The matable connector assembly as set forth in claim 1 wherein said electrical component is a battery.

3. The matable connector assembly as set forth in claim 1 wherein said circuits of said portable apparatus are defined on a circuit board.

4. The matable connector assembly as set forth in claim 1 wherein said circuits electrically connected to said second contact members are conductors of a cable.

5. The matable connector assembly as set forth in claim 1 wherein said first and second connectors are adapted to be secured together in fully mated engagement in a manner permitting intentional unmating.

6. The matable connector assembly as set forth in claim 1 wherein all of said third contact members are deflectable out of engagement by respective said protuberances of said second connector.

7. The matable connector assembly as set forth in claim 1 wherein said first connector includes a shroud section extending forwardly of said first mating face and said second connector includes a plug section defining said second mating face and complementary with said shroud section to be received thereinto, said shroud section includes a recess extending thereinto from a leading edge thereof through which extends said spring arm section of each said selected third contact section angled rearwardy and laterally to said first contact section and a free end, and each said protuberance of said second connector is shaped and dimensioned to be received into a corresponding said recess for said camming surface thereof to engage a said bearing surface of said spring arm section of said selected third contact section.

8. The matable connector assembly as set forth in claim 1 wherein said first connector housing includes a relief region adjacent a free end of said spring arm section of at least each said selected third contact member whereinto said free end is movable upon deflection of said spring arm section by a respective said protuberance during connector mating.

9. The matable connector assembly as set forth in claim 8 wherein said spring arm section of each said third contact member extends to a free end trapped against a lip of said first housing adjacent said relief region upon assembly of said first connector in said portable apparatus, enabling said first contact section of said third contact member to be disposed precisely a selected distance from said first housing to assuredly engage a said component electrode during full assembly of said portable apparatus and be spring biased toward said first connector housing upon full assembly, assuredly establishing an electrical connection with said component electrode.

* * * * *